United States Patent [19]

Kircher et al.

[11] 4,227,987

[45] Oct. 14, 1980

[54] MEANS FOR CONNECTING AND DISCONNECTING CELLS FROM CIRCUIT

[75] Inventors: Morton S. Kircher, Clearwater, Fla.; Steven J. Specht, Mentor, Ohio

[73] Assignee: Olin Corporation, New Haven, Conn.

[21] Appl. No.: 97,115

[22] Filed: Nov. 26, 1979

[51] Int. Cl.[3] ..... C25B 15/00; C25B 9/04

[52] U.S. Cl. ..... 204/228; 204/253; 204/267

[58] Field of Search ..... 204/228, 253–258, 204/267–270, 279

[56] References Cited

U.S. PATENT DOCUMENTS

| | | | |
|---|---|---|---|
| 1,766,875 | 6/1930 | Buck | 204/253 X |
| 2,649,510 | 8/1953 | Michaelis | 204/228 X |
| 3,432,422 | 3/1969 | Currey | 204/258 |
| 3,574,083 | 4/1972 | Pewitt | 204/258 |
| 3,700,582 | 10/1972 | Giacopelli | 204/258 X |
| 3,783,122 | 1/1974 | Sato et al. | 204/279 |
| 3,859,196 | 1/1975 | Ruthel et al. | 204/279 X |
| 3,930,978 | 1/1976 | Strewe et al. | 204/228 |
| 4,078,984 | 3/1978 | Strewe | 204/228 |

FOREIGN PATENT DOCUMENTS

| | | | |
|---|---|---|---|
| 2055161 | 5/1971 | Fed. Rep. of Germany | 204/228 |

*Primary Examiner*—Howard S. Williams
*Assistant Examiner*—D. R. Valentine
*Attorney, Agent, or Firm*—Bruce E. Burdick; Thomas P. O'Day

[57] ABSTRACT

A jumper system for electrically by-passing one of a series of electrolytic cells without interrupting current flow through the remaining cells is disclosed. The jumper system includes two L-shaped conductors, a switch for electrically connecting the conductors, and a contact pressuring device for remotely moving the conductors into pressurized contact with the cell preceding and the cell following the cell to be disconnected.

20 Claims, 12 Drawing Figures

MEANS FOR CONNECTING AND DISCONNECTING CELLS FROM CIRCUIT

This invention relates to devices for connecting and disconnecting electrolytic cells from a series electrical circuit, such as in a chloralkali plant.

In order to minimize the amount of space and material required to conduct electrical current within commercial electrolytic cell plants, it is preferred to operate electrolytic cells at the highest practical safe voltage. For chlor-alkali cells, 400 volts is widely considered such a safe maximum. Also, for maximum technical and economic efficiency, it is preferred that the current capacity (production capacity) have a certain relationship with the total plant production required, i.e. to have one or two circuits of cells provide the entire plant production capacity. Chloralkali plant capacity has increased from 300 tons of chlorine per day typical for the year 1960 to 1,000 tons of chlorine per day typical for the year 1977, and preferred current capacity for diaphragm cells has increased from 30,000 amperes to 150,000 amperes. In fact, there is currently justification for cells of 300,000 amperes of capacity.

Two different approaches have been taken to provide time out of production for cell maintenance. One is to shut down an entire cell circuit for maintenance (sometimes preferred when a large number of circuits are available). The other, more usual method, is to by-pass current around one cell at a time, and to replace the cell with a spare cell already reconditioned. It is the latter method with which the invention is concerned. The design of cells for maximum economy favors the shortest current path within the cells and in the connections between the cells. Capital charges on the installed cost of conductors and power cost for the power losses in the conductors are approximately equal factors in the economic considerations.

With the larger new cells and with enhanced awareness of safety, it has become a major problem to design systems for short-circuiting and removing cells. Attempts which have been made to date have not been fully successful because of high costs of construction and retained hazardous features. The cell disclosed in U.S. Pat. No. 3,859,196 by Ruthel and Evans, issued Jan. 7, 1975, to Hooker Chemicals and Plastics Corporation provides heavy copper reinforcements to the anode conductors and cathode conductors of each cell to bring terminals forward so that the short-circuiting switch can be connected by workmen standing in the aisle in front of the cells. A large number of long inter-cell connectors between cells must be removed manually. This system is expensive in extra copper and expensive in power loss due to the long connections between cells. Also, the Hooker (Ruthel et al) system requires heavy manual work between cells, which is a retained safety hazard.

Friedrich Uhde GmbH attempted to overcome the disadvantages of Ruthel and Evans by developing the device disclosed in U.S. Pat. No. 3,930,978, by Strewe et al, issued Jan. 6, 1976. Strewe et al used an increased length-width ratio for the cell and attached the short circuiting switch under the cell, using a cell room with two floors. The Strewe solution saves the cost of extra copper within the cell but has added disadvantages of requiring an extra floor in the cell building and of requiring switch connections to be made overhead in a hazardous location.

For older, smaller (40 KA or less) cells the connection method disclosed in U.S. Pat. No. 3,432,422 by Currey, issued Mar. 11, 1969, to Hooker Chemical Corporation was widely used. The current path during short circuiting approached the minimum, as is desirable and also no extra copper was provided for attachment of the short circuiting switch. Currey provided dual connections both of which were in service during normal operations. One connection was disconnected and attached to the jumper switch arm for short circuiting, then the other connection could be disconnected. However, this Currey system required manual work between cells to disconnect connectors and thus required extra floor space and hence increased construction costs. The Currey system also required a heavy extra bus bar to connect the cathode terminals during short circuiting and supplied current to only one of the anode terminals of the following cells.

Sato and Inoy in U.S. Pat. No. 3,783,122 which issued Jan. 1, 1974 to Showa Denko Kabushiki Kaisha, alleged solution of the extra space requirement of the Currey connection method by adding extra copper to the anode and cathode terminals of the cell to extend the terminals forward into the aisle alongside the cells. Space is saved between cells and connections are more accessible. However, since in the Sato design, current must be collected and taken to the front and back of the cell, the terminals would have to be enormous or expensively cooled or both when used on the large capacity cells presently being designed and built. The cell of Ruthel shows such an expensive and elaborate terminal and cooling system.

There is a need for a system for taking large capacity diaphragm cells out of service which does not require the addition of a large amount of extra conductor on each cell solely for the short-circuiting requirement, which does not require an extra floor in the cell building, and which does not require personnel access into hazardous locations for switch attachment or cell disconnection.

Therefore, it is an object of the present invention to provide a design for jumper system suitable for cells having a rated capacity of 130,000 to 500,000 amperes. It is a further object of the invention to provide a system for connecting electrolytic cells in a manner which enables by-pass of one of the cells while still providing a current pass for normal operation between the cells which is close to the minimum possible.

It is a still further object of the invention to provide an inter-cell conductor and an inter-cell conductor which can be used in combination for optimum normal operation without excess metal being required for short-circuiting purposes.

It is a further object of the invention to provide means for short-circuiting individual cells and removing them without entry of personnel between or under cells. It is a further object of the invention to provide a short-circuiting switch with connection arms capable of entering between cells and making long, narrow electrical contact with the appropriate cell terminals, the switch and switch arms being designed to carry full current at conservating rating and including means for making fast the connections by remotely controlled mechanism.

It is a further object of the invention to provide inter-cell connectors which make lengthy contact with the terminal cell connectors or substantially the full length of the terminal cell connectors or at least a length one-third the length of the cell terminals to which they are connected.

It is a further object of the invention to provide a means for applying pressure on the contact surfaces and means for releasing pressure by remote control.

It is a further object of the invention to provide means for removing the inter-cell connectors in conjunction with the cell removal, without requiring entry of personnel between cells.

It is another object of the invention to provide means for cleaning contact surfaces on the terminals between cells without requiring personnel entry.

These objects are achieved by the present invention which provides a jumper system for electrically bypassing one cell of a plurality of chloralkali diaphragm cells connected in an electrical series circuit without interrupting the electrical flow through the other cells in said circuit, where each of said cells has vertical anodes and cathodes oriented parallel to the overall direction of current flow in said circuit, cathode and anode terminals lying transversely between said cells and oriented parallel to said overall direction, an anode current distributor connecting said anodes to said anode terminal and a cathode current collector connecting said cathodes to said cathode terminal, said jumper system comprising:

first transverse conductor means, for assuming a position extending parallel to said cathode terminal and contacting in such position the lengthwise center of the cathode terminal of the cell preceding said one cell in said circuit at a location between said one cell and said preceding cell and for conducting current from said terminal in a direction transverse to said overall direction;

second transverse conductor means for assuming a position extending parallel to said anode terminal and contacting in such a position an anode terminal of the cell following said one cell in said circuit at a location between said one cell and said preceding cell and for conducting current from said terminal in a direction transverse to said overall direction;

controlled means for remotely moving said first and second conductors into pressurized contact in said parallel position with said cathode terminal of said preceding cell and said anode terminal of said following cell respectively; and switch means, adapted to be positioned adjacent said one cell, for selectively allowing and preventing electrical current flow from said first transfer arm to said second transfer arm, whereby current bypasses said one cell.

The objects and advantages of the present invention will be better understood by reference to the attached drawings, in which.

DETAILED DESCRIPTION OF BEST MODE

Figure 1:
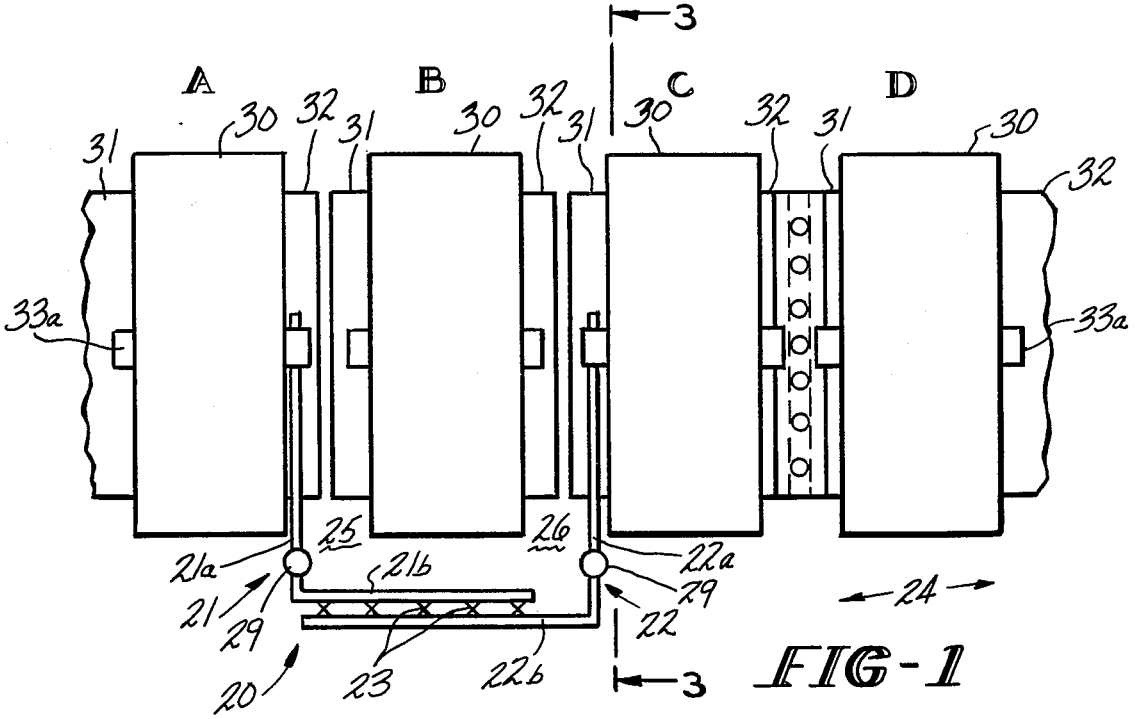
FIG. 1 is a top, plan view of a series of four electrolytic cells connected in electrical series, showing the connection of the jumper switch of the invention to the cells.
Figure 2:
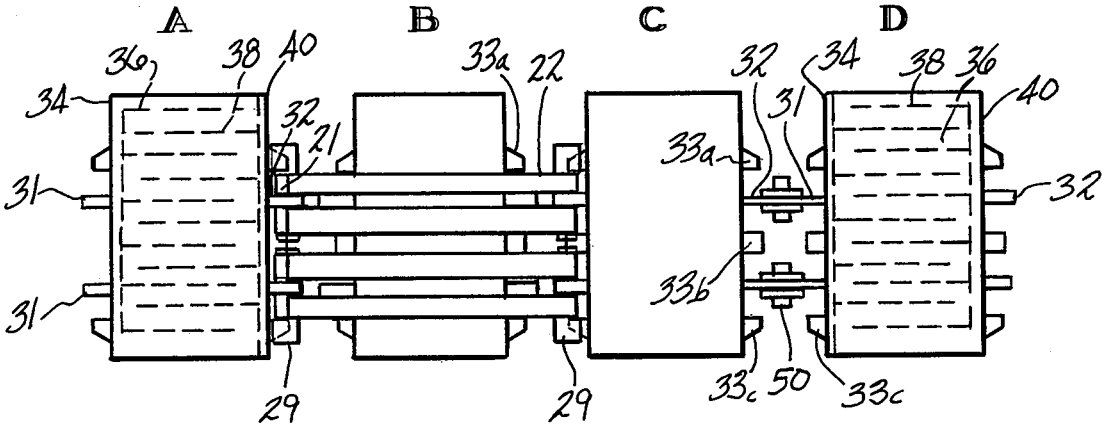
FIG. 2 is a side, elevational view of the cell series of FIG. 1 showing the connection of the cell terminals with the jumper system of the invention.

FIG. 1 is a plan view of a series of four electrolytic cells A, B, C, and D. A jumper system 20 is provided in order to help disconnect cell B from cells A, C, and D. Jumper system 20 comprises a first L-shaped conductor 21, a second L-shaped conductor 22, a mover means 29, lever lugs 33*a, b, c* on cells A, B, and C, a switch means 23 for selectively, electrically connecting conductor 21 and 22 together. Each of cells A, B, C, and D is comprised of a cell body 30, two anode terminals 31, two cathode terminals 32, and six "lever lugs" 33*a*, 33*b*, 33*c*, (see FIG. 2). Cells A, B, C and D could have more than two or less than two anode terminals and more than two or less than two cathode terminals if desired. Lever lugs 33*a, b, c* serve to hold the free end of conductors 21 and 22 to prevent the free ends of the conductors 21 and 22 from pivoting out of contact with terminals 32 and 31 when the switch ends of conductors 21 and 22 are moved toward each other as described below. In order to disconnect cell B from cells A and C, it is first necessary to electrically connect cathode terminals 32 of cell A to anode terminal 31 of cell C so that when cell B is disconnected, electrical flow through cells A, C, and D is not interrupted. It is not desirable to interrupt the current flow through cells A, C, and D since such interruption would obviously decrease the amount of production which could be obtained from cells A, C, and D during the time cell B is disconnected. Since present day chlor-alkali cells may generate as much as 5 tons per day or more of product, it is of extreme economic importance not to miss any more production time than is absolutely necessary. This is especially true where a series of cells comprises 50 or 100 or more of such cells. A shut-down of a couple of days in such a plant would mean hundreds of thousands of dollars of lost production. Jumper system 20 is located in an aisle 24 adjacent cells A, B, C, and D with conductors 21 and 22 projecting into the spaces 25, 26 between cells A and B and cells B and C respectively, and FIGS. 2 show the electrical by-pass circuit established by engagement of jumper system 20 with cells A and C. Cells A, B, C, and D are connected in electrical series and have vertical electrodes lying parallel to the direction of overall current flow through the series. That method saves on the amount of copper needed to connect the cells and on the amount of copper needed to allow for bypassing of cells. Current from any suitable electrical DC power source is provided to anode terminal 31 of cell A and flows in conventional manner from anode terminal 31 of cell A to a current distributor 34 to anode conductor rods 36 to an anode surface (not shown) through an electrolyte (not shown) to a cathode surface (not shown) to cathode conductor rods 38 to a cathode current collector 40 to cathode terminals 32 to conductor 21. Similarly, current flows through switch 23 to conductor 22 to anode terminal 31 of cell C and through a similar anode current distributor, anode conductor rods, anode surface, electrolyte, cathode surface, cathode conductor rod, cathode collector to cathode terminal 32 of cell C. From cathode terminal 32 of cell C, current flows through intercell connector 50 to anode terminals 31 of cell D, through cell D in similar fashion to that through cell C and then to cathode terminals 32 of cell D and from cathode terminal 32 to any suitable electrical means for completing the circuit. It is therefore apparent that the electrical flow has by-passed cell B. In FIG. 1, conductors 21 and 22 contact terminals 31 and 32 over a length at least one-third the length of cell terminals 31 and 32. As respects the cells and terminals "length" refers to the direction transverse to the overall current flow direction, since cells A, B, C, and D are longest in that direction and since that is the direction in which conductors 21 and 22 extend. This optional length of contact is desirable in order to minimize the amount of current which terminals 31 and 32 must carry during short-circuiting, i.e. when they are connected to conductors 22 and 21 of jumper system 20. More important is the point at which conductors 21 and 22 contact terminals 32 and 31, respectively. It is most desirable that arm 21 contact terminal 32 at some point in the middle third of cell terminal 32 in order that, at most, cell terminal 32 would have to carry two-thirds of the total current of cell A. More preferably, the conductor 21 would contact terminal 32 at the center point of terminal 32 so that terminal 32 would at most only have to carry one-half of the total current through cell A. Lever lugs 33*a, b, c* could be located even with the longitudinal center of terminals 31, 32 so as to press conductors 21 and 22 into contact with that center point. Even more preferable, conductor 21 would be of sufficient length so that the current load required to be carried by any portion of cell terminal 32 would be less than one-quarter of the total cell current through cell A, or more preferable less than one-tenth. In fact, one optimum length of contact would be for conductor arm 21 to contact the entire length of cell terminal 32 as is preferably the case for the arms 21 and 22 of FIG. 12 below so that cell terminal 32 would not have to carry any excess current whatsoever during short-circuiting. The same thing applies to the relationship between conductor 22 and cell terminal 31 of cell C. If these relationships are maintained, as desired, then the amount of material which must be provided in cell terminals 31 and 32 is drastically reduced and a major cost reduction can be obtained in the overall cell plant.

Conductor 21 is initially placed between an intercell connector 50 and cell body 30 of cell A. Similarly, conductor 22 is initially placed between an intercell connector 50 and body 30 of cell C. The intercell connectors 50 are then loosened and moved so as to disconnect terminal 32 of cell A from terminal 31 of cell B and terminal 32 of cell B from terminal 31 of cell C. FIG. 1 shows the position of the cell series and jumper system 20 following removal of the intercell connectors 50 between cells A and B and cells B and C. However, between cells C and D there is still shown an intercell connector 50 so that the positioning of conductors 21 and 22 can be better understood. In FIG. 2 it is noted that intercell connector 50 overlaps the outerends of terminals 32 and 31 so that the inner cell C and cell D portion of terminals 31 and 32 is exposed. Conductor 21 and conductor 22 are moved into spaces 25 and 26 and clamped around this exposed inner portion of terminals 32 or 31, as noted above. Since the width of the exposed inner portion of terminals 32 and 31 is less than the full width of terminals 32 and 31, it is preferable that conductors 21 and 22 be relatively narrow so that they can fit onto that exposed portion. One preferable width for conductors 21 and 22 would be approximately one-half the width of terminals 32 and 31. Conductors 21 and 22 can be made relatively tall in order to have sufficient cross-sectional area to carry a large amount of current from cell A to cell C. The exact height would be a matter of design choice dependent on cell size, terminal length and number of terminals and current to be carried. One suitable conductor size would be, for example, 4" wide by 10" tall copper bars for a 150 kiloampere cell with terminals 31 and 32 each being 9" wide. Conductors 21 and 22 are preferably this massive to aid air cooling and for conductivity. Arms 21 and 22 could be multiple rather than single, if desired to give greater surface area for heat loss.

Intercell connector 50 is shown as a bolted pair of parallel conductive plates in FIG. 2. However, other suitable intercell connectors could be utilized and other means of attaching the intercell connectors to terminals 32 and 31 could also be utilized. For example, intercell connector 50 could be hinged to either terminal 32 or 31 and be simply rotated out of engagement with the other of terminals 32 and 31. In such a case, the movable side of the intercell connector would be provided with suitable fastening means to assure a pressure contact in its normal position connecting terminals 31 and 32. It is very important that a high contact pressure be established and maintained between conductors 21, 22 and terminals 32, 31 so that surface irregularities are flattened. A contact pressure of 3,000 pounds per square inch is preferred for this purpose. A bolted connection can achieve such a pressure. As shown in FIG. 2, the intercell connector 50 can be removed by loosening bolts. The loosened connector 50 can then be slid longitudinally along terminals 32 and 31 into the aisle on the opposite side from jumper system 20. Such removal could be done by remote controlled automatic means such as a crane or a hoist, if desired. Remote control would be preferable to minimize the hazard to personnel inherent in manual operations between cells. This is especially so where, as is preferable, the spacing between cells is at a minimum. An alternative intercell connector movement would be a "slide-back" type system in which notches were provided in either terminal 32 or 31 and the bolts of intercell connector 50 were slid laterally into such notches, this movement being toward the cell to be disconnected. Such movement could be remotely controlled by use of a hydraulic jack or a pneumatic jack with appropriate remote operation. Such a remote operated hydraulic jack would be preferably inserted into spaces 25 and 26 from the side of the series of cells opposite jumper system 20 or the hydraulic jack could be designed to fit around jumper system 20.

Yet another alternative would be to have only a single pair of conductors 21 and 22 to connect each pair of terminals 31 and 32, rather than having a double pair of conductors 21 and 22 for each pair of terminals 31 and 32. This change would require that the single pair of conductors 21 and 22 be of much more substantial dimension and preferably a backup plate (see plate 21*d* of FIG. 6) would be placed on the opposite side of terminals 31 and 32 from the remaining single pair of conductors 21 and 22 in order that pressurized contact could be maintained by squeezing terminals 32 and 31 between conductors 21 and 22 and the back up plates, 21*d* respectively without damage to terminals 31, 32. The use of a backup plate 21*d* or "stiffener plate" (see FIG. 6) could reduce the amount of expensive conductive material necessary and further to provide an added amount of rigidity to the conductor-terminal couple when engaged.

Switching device 23 includes a number of commercially available switch units, preferably vacuum switches such as Westinghouse Basic Modules model WX-32823 which are gang connected to a pneumatically operated mechanism. The L-shaped conductors 21 and 22 are held in an insulated rack 42 shown in FIGS. 3 and 4. The long arm 22(*a*) of each conductor 22 and the long arm 21(*a*) of each conductor 21 are provided with a contact pad 21(*c*) and 22(*c*) respectively. Contact pads 21(*c*) and 22(*c*) are preferably replaceable in order that they may be replaced if they are damaged by the high-current load during use so that there is no necessity to replace long arm 21(*a*) or 22(*a*). Pads 21(*c*) and 22(*c*) could include silver contacts, preferably replaceable, to minimize such damage. The short arm 21(*b*) and 22(*b*) (see FIGS. 1 and 6) of conductors 21 and 22 are each joined mechanically by insulating holders within rack 42 (see FIG. 3) and are connected or disconnected electrically by the unit switches. The horizontal pairs of "L-shaped" conductors 21 and 22 cooperate with a like set of conductors 21 and 22 in a low vertical plane. The two vertical pairs of conductors hinged together with a slight amount of variable space to form "alligator" jaws to grip the long thin horizontal terminals 31 and 32 of the respective cells A and C to be shorted. Pads 21(*c*) and 22(*c*) are preferably long enough to reach between cells to make contact with the cell terminals 31 and 32 over a length within the range of form about 25% to about 100% of the length of terminals 31 and 32. Lever lugs 33*a, b, c* (shown in FIGS. 1, 2, and 3 only), attached to cell B, serve to help maintain the right or "outer" end (FIG. 3) of arms 22*a* in contact with terminals 31 during movement of arms 22*a* toward each other. While conductor pads 21(*c*) and 22(*c*) are preferable, it will be understood that system 20 is operational even if pads 21(*c*) and 22(*c*) are omitted so that terminals 31 and 32 are contacted directly by long arms 21(*a*) and 22(*a*). Also, it will be appreciated that there may be more than one contact pad 21(*c*) or 22(*c*) for each long arm 21(*a*) or 22(*a*) and conversely there may be more than one long arm 21(*a*) or 22(*a*) for each contact pad 21(*c*) or 22(*c*).

Figure 3:
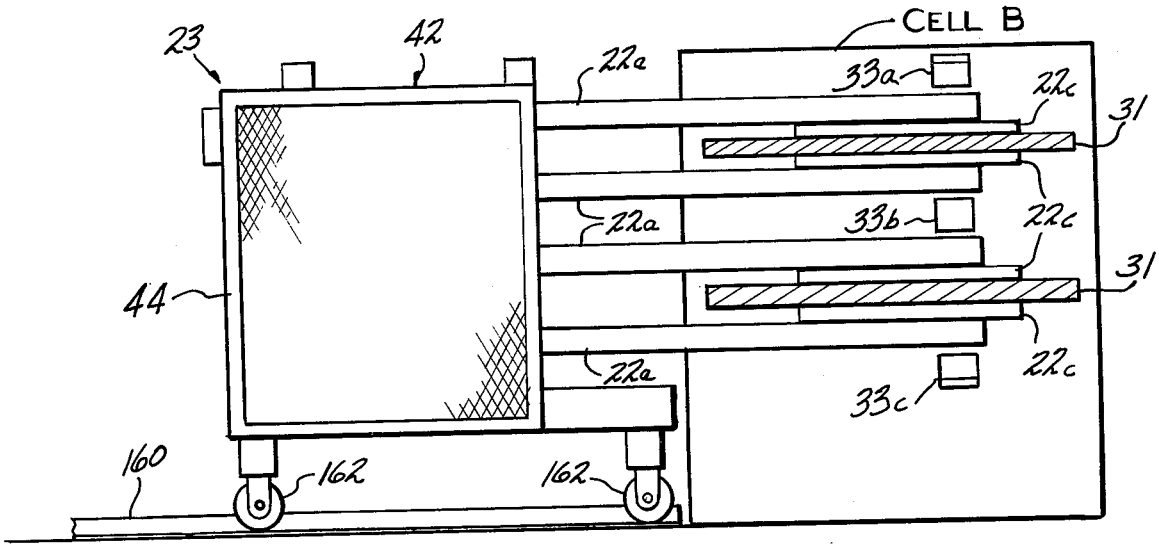
FIG. 3 is an elevational, cross-sectional view taken along lines 3—3 of FIGS. 1 and 2, showing in greater detail the connection of the jumper system of the invention to the cell terminal.
Figure 4:
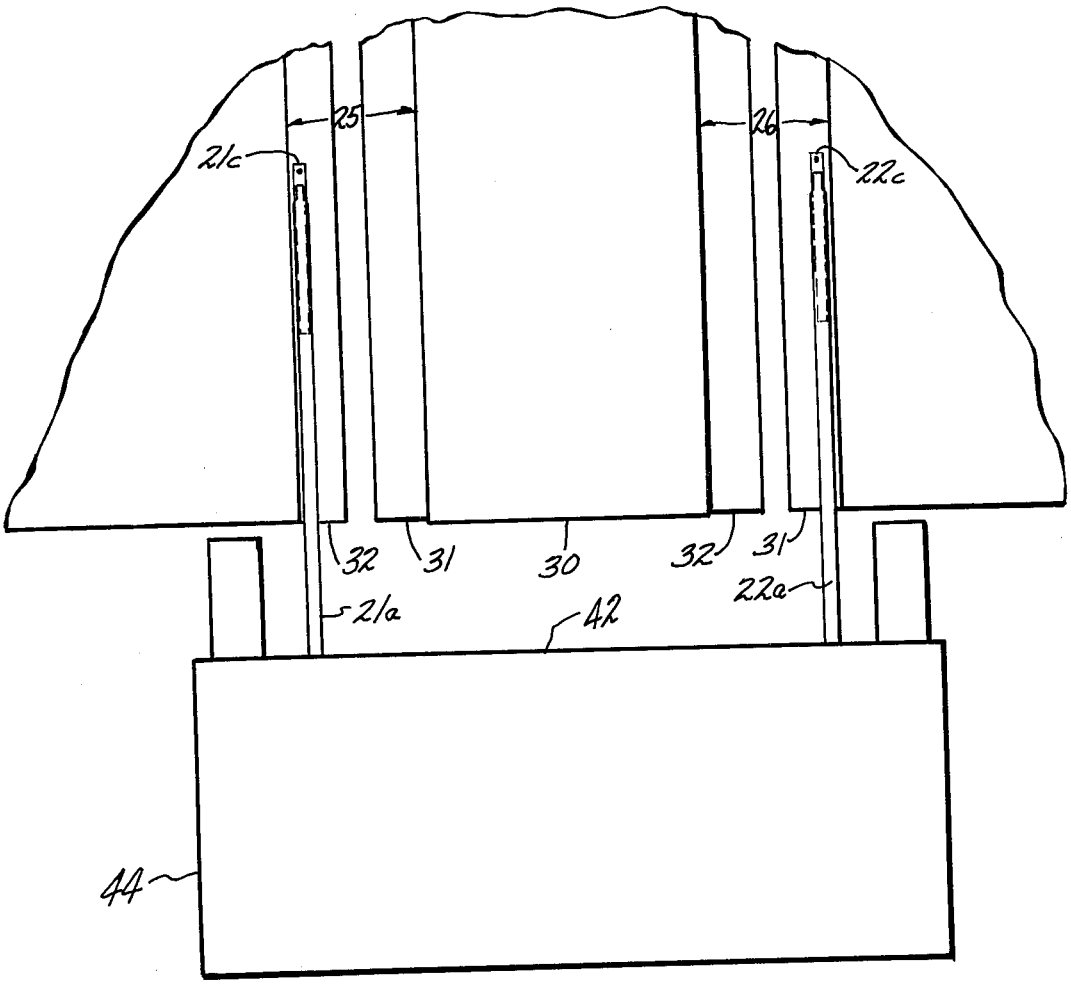
FIG. 4 is a top, exploded, plan view of the attachment of the jumper system of the invention to the cell terminals.

FIGS. 3 and 4 show in greater detail how long arms 21(*a*) and 22(*a*) can be much taller than wide in order to fit between the cells yet carry the high current.

Figure 5:
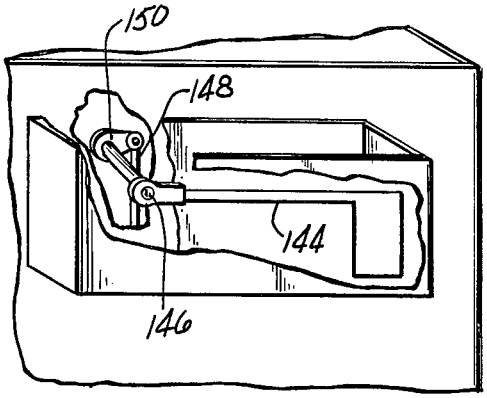
FIG. 5 is a perspective, cut-away view of a signal means which can be used with the present system of FIGS. 1–4 in order to indicate electrical engagement of the system.

FIG. 5 will be discussed later below.

Figure 6:
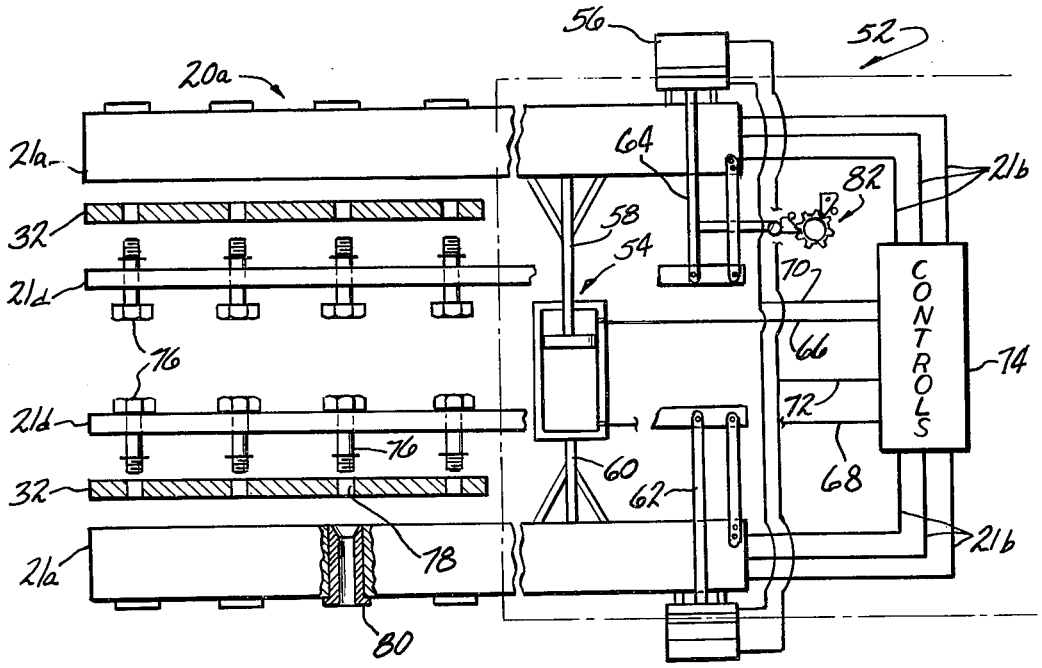
FIG. 6 is a side, elevational schematic view of a preferred remotely controlled pneumatic system for engagins the jumper system of the present invention.

FIG. 6 shows a schematic, side elevational view of a remotely controlled pneumatic system for engaging the jumper system 20(*a*). The pneumatic controls would preferably be mounted within a box-like structure 44, (see FIGS. 3 and 4) which contains the rack 42 for holding the conductors 21 and 22 and which also contains switch mechanism 23 (see FIG. 1). The remotely controlled pneumatic system 52 of FIG. 6 and FIG. 7 includes one piston and cylinder assembly 54 and two piston and cylinder assemblies 56, four connecting links 58, 60, 62, and 64, four pneumatic supply lines 66, 68, 70, and 72, and a control section 74. The jumper system 20(*a*) of FIG. 6 is different from that of FIGS. 1–5 in that instead of having two pairs of conductor arms 21(*a*) lying on opposite sides of terminals 32, jumper system 20(*a*) has, instead of the center two conductors 21(*a*), two stiffener plates 21(*d*) lying on opposite sides of terminals 32 from the outer two conductor arms 21(*a*). Stiffener plate 21(*d*) serves to hold a plurality of captive bolts 76 which can be inserted through openings 78 in terminals 32 and tightened into threaded sleeves 80 of arms 21(*a*) in order to exert a large contact pressure between arms 21(*a*) and terminals 32, for reasons noted before above. Captive bolts 76 and threaded sleeves 80 and openings 78 can be better understood by reference to FIG. 11. When it is desired to engage arms 21(*a*) with terminals 32 fluid is fed to assembly 54 through supply lines 66 and removed from cylinder 54 through line 68 thus contracting piston and cylinder assembly 54 and pulling links 58 and 60 inwardly toward assembly 54. Conversely, when it is desired to disengage arms 21(*a*) from terminals 32 fluid is supplied through line 68 to assembly 54 and removed from assembly 54 through line 66 so as to expand assembly 54 and push links 58 and 60 outwardly. Similarly, when it is desired to engage stiffener plates 21(*d*) and captive bolts 76 with arms 21(*a*), fluid is supplied to piston and cylinder assemblies 56 through lines 70 and withdrawn from assemblies 56 through lines 72 so as to contract assemblies 56 to move links 62 and 64 outwardly. Once in this position, captive bolts 76 are tightened into threaded sleeves 80 by a remotely operated bolt tightener (not shown). Such a bolt tightener is disclosed and claimed in a copending commonly invented and commonly assigned application entitled, "Automatic Intercell Connector Tightener". When it is desired to disengage captive bolts 76 and stiffener plate 21(*d*) from terminals 32 and conductor arms 21(*a*), captive bolts 76 are loosened by the bolt and then fluid would be supplied through lines 72 to assemblies 56 and withdrawn from assemblies 56 through lines 70 so as to expand assemblies 56 and pull length 62 and 64 inwardly toward assembly 56.

Also shown in FIG. 6 is a rachet-type counter 82 for counting the number of times arms 21(*a*) are moved into contact with terminals 32. This optional counter 32 serves to give an indication of the number of operations so that preventive maintenance procedures can be taken when a certain number of operations have occurred.

Figure 7:
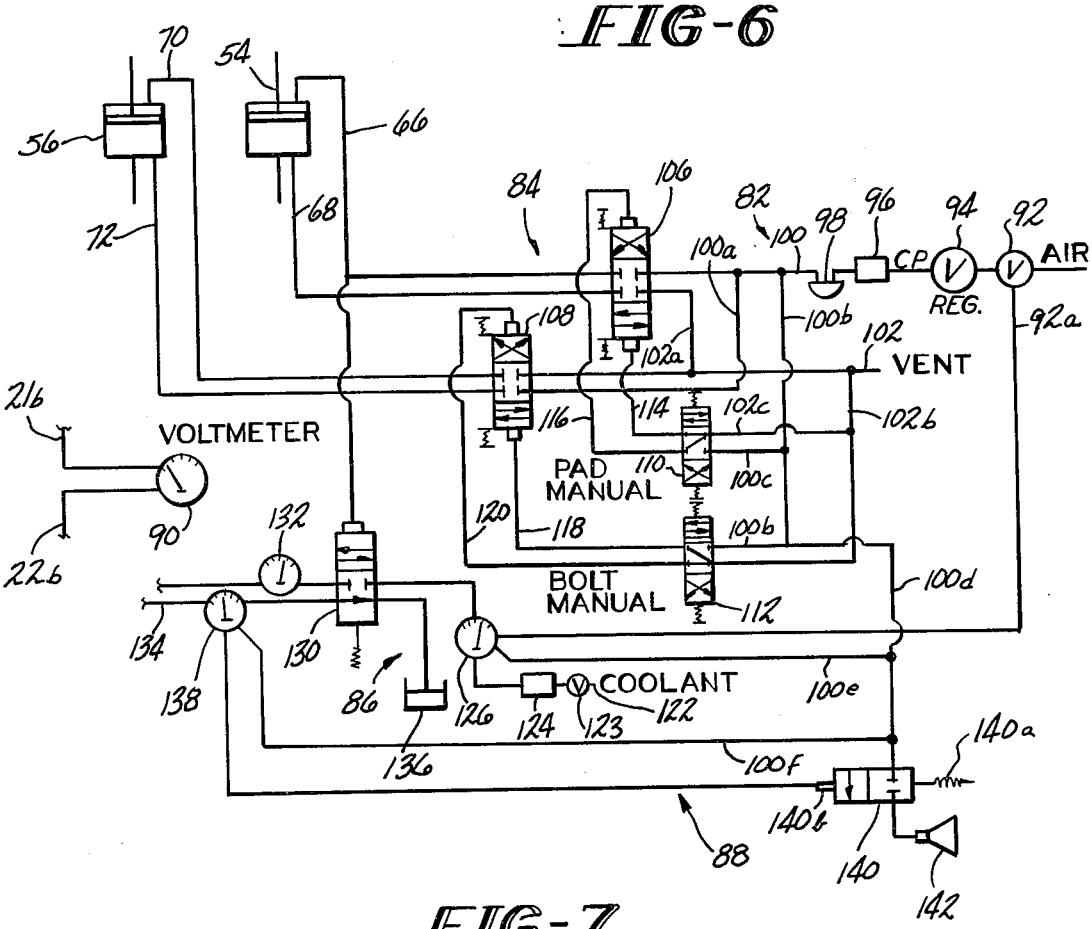
FIG. 7 is a schematic view of a preferred pneumatic controlled system which allows the remote control of the jumper system of the invention.

FIG. 7 shows a schematic diagram of pneumatic control section 74 of jumper system 20(*a*) of FIG. 6. Pneumatic control section 74 allows remote operation of the jumper system 20(*a*). Section 74 is detailed to show a typical detailed pneumatic circuit for remote control. Other systems could be utilized effectively as control section 74. Section 74 could even be replaced by a hydraulic or electrical section, if desired. Control section 74 includes air supply circuit 82, control valve section 84, coolant section 86 and alarm section 88. It is also very desirable that a voltmeter 90 be included to measure the voltage between conductor 21(*b*) and 22(*b*)

in order to determine the voltage drop through the jumper system. Pressurized air supply 82 includes a control valve 92, a regulator valve 94, a filter 96, and an oiler 98, all conventional. Control valve 92 is also provided with a tap line 92*a* which leads to coolant system 86, for reasons below described. Air supply 82 also includes a flow line 100 leading to control valve section 84 and through line 100*d*, alarm section 88, for reasons below described.

Control valve section 84 includes a main pad control valve 106 and a main bolt control valve 108 and pressurized air supply lines 100 and 100*a* and vent lines 102 and 102*a*. Control valve section 84 can preferably also include an auxiliary pad control valve 110 and an auxiliary bolt control valve 112 and pressurized air supply lines 100*b* and 100*c* and vent lines 102*b* and 102*c* associated therewith. Main control valves 106 and 108 are three positioned, four-way, normally closed flow control valves of conventional design. They are movable from their normal position preventing flow between pressurized air line 100 and vent line 102 through piston assemblies 54 and 56, respectively. Valve 106 is normally in the position indicated in FIG. 7, in which position there is no fluid communication between lines 100, 102(*a*) and lines 66, 68. Valve 106 can be moved downwardly to allow communication between line 100 and line 68 and between lines 102(*a*) and 66 thus causing assembly 54 to expand. Alternately, valve 106 can be moved upwardly to allow communication between line 100 and line 66 and between lines 68 and 102(*a*), whereby assembly 54 will contract. Similarly, valve 108 normally prevents fluid communication between lines 102, 100(*a*) and lines 70,72. Valve 108 can be moved upwardly to allow communication between line 100(*a*) and line 72 and between line 70 and line 102, whereby each assembly 56 is expanded. Alternately, valve 108 can be moved downwardly whereby line 100(*a*) is connected to line 70 and 72 is connected to line 102, whereby each assembly 56 is contracted. In many cases it would be sufficient that valves 106 and 108 be simply manually controlled valves. However, from a safety standpoint, it may be desirable to actually control the opening and closing from a more remote location and in such case it may be desirable to add an additional pair of auxiliary control valves 110 and 112 and make control valves 106 and 108 be operated by such auxiliary control valves as seen in FIG. 7. Auxiliary control valve 110 is connected to the bottom of main pad control valve 106 by line 114 and is connected to the top of valve 106 by line 116. Auxiliary valve 110 is also connected to lines 110(*c*) which supplies pressurized air and by line 102(*c*) to vent. Valve 110 is a conventional, manually-operated, three positioned, four-way, pneumatic valve. In its normal position, valve 110 prevents fluid communications between lines 100(*c*) and lines 114, 116, but connects lines 114, 116 to vent line 102(*c*). Valve 110 can be moved upwardly to allow pressurized air to flow from line 100(*c*) into line 114 and venting the top of valve 106 through line 116 to line 102*c* so as to move valve 106 upwardly, thereby closing "jaws" or conductor arms 21(*a*). Valve 110 can conversely be moved down to connect line 100(*c*) with line 116 and connect line 102(*c*) with line 114 so as to provide pressurized air to the top of valve 106 and vent the bottom of valve 106 thereby moving valve 106 downwardly and opening or uncontacting arms 21(*a*). Valve 110 is preferably provided with springs at its opposite ends so that when manual pressure is released from valve 110 it will assume its "vented" center position. When it is said that the center position of valve 110 is "vented" what is actually meant is that lines 114 and 116 are connected to vent line 102(*c*) and pressurized air supply line 100(*c*) is closed so that pressure is removed from both the top and bottom valve 106 so that valve 106 can assume its normally closed position. Valve 106 could be provided with springs at its upper and lower end for this purpose. In this way, the pneumatic system will hold its position long enough for captive bolt 76 to be tightened into threaded sleeve 80. Once bolt 76 and sleeve 80 are interconnected it becomes irrelevent whether or not any slow leaks in the pneumatic system exist since bolt 76 and sleeve 80 can maintain the desired contact pressure between conductor arms 21(*a*) and terminals 32.

Similarly, valve 112 can be moved up to connect line 100(*b*) with line 120 and line 118 with line 102(*b*) so as to pressure the top of valve 108 and move valve 108 down to contract assembly 56 and thus insert bolt 76. Alternately, valve 112 can be moved down to connect line 100(*b*) with line 118 and line 120 with line 102(*b*) to pressurize the bottom of valve 108 and move valve 108 up thereby expanding assembly 56 and removing or withdrawing bolt 76 if bolt 76 is loosened from nut 80. Valve 112 would not be moved upwardly if bolt 76 were threaded as any attempt to expand assembly 56 when bolts 76 were engaged with threaded sleeve 80 might damage stiffener plate 21(*d*) or some other part of the apparatus. Like valve 110, valve 112 would preferably be provided with springs at its upper and lower end to bias it towards its center position in which line 118 and 120 were connected to vent line 102(*b*) so as to remove pressure from the top and bottom of valve 108 and allow valve 108 to assume its center position. Valve 108 would therefore preferably be provided with springs at its upper and lower end to bias valve 108 toward its "vented" center position.

Coolant system 86 includes coolant supply line 122, control valve 123, coolant filter 124, first pressure responsive valve 126, a two-positioned four-way pressure responsive shut-off valve 130, a pressure gauge 132, a return line 134 and a coolant reservoir 136. When valve 123 is open, line 122 continuously provides pressurized coolants through coolant filter 124 to pressure responsive valve 126. If valve 126 senses that there is less than some preset pressure difference between line 100(*e*) and line 92(*a*) valve 126 will open to allow coolant to flow to valve 130. Valve 126 thereby serves to allow coolant to flow to valve 130 only when valve 92 is open, that is, when line 100 is pressurized. Valve 130 is normally closed but opens when line 66 is pressurized since line 66 is connected to the top of valve 130 and shoves it downwardly against a spring bias when pressurized. If line 66 is not pressurized, valve 130 nevertheless allows flow from line 134 into reservoir 136 so that coolant may be drained from the system when the system 20(*a*) is not in operation. Gauge 132 serves to measure the coolant pressure which is fed to arms 21(*a*) or other parts of system 20(*a*) as desired to prevent overheating due to the large amount of current passing through system 28 during short-circuiting operation. Line 134 receives the hot coolant from system 20(*a*) and drains that hot coolant into reservoir 136.

Alarm circuit 88 includes temperature sensor 138, pressure supply line 100(*f*), pressure supply line 100(*d*) alarm valve 140, and alarm 142. Pressure supply line 100(*d*) is connected through valve 140 to alarm 142. However, valve 140 is normally closed in response to the bias of a spring 140(*a*). Valve 140 can be open to connect pressure line 100(*d*) to alarm 142 upon valve 138 sensing excessive coolant temperature in line 134 of coolant system 86. For this purpose, line 100(*d*) is in constant fluid communication with line 100(*f*) leading to the side of valve 140 opposite spring 140(*a*). Valve 138 is placed in line 100(*f*) and line 134 so that valve 138 can sense temperature in line 134 and control the flow in line 100(*f*) in response to that temperature. If valve 138 senses too high a coolant temperature in line 134, valve 138 opens allowing pressurized air to flow through line 100(*f*) to the end 140(*b*) of valve 140 opposite spring 140(*a*) to thereby move valve 140 to the right and connect line 100(*d*) with alarm 142 to sound alarm 142. Alarm 142 can be a conventional air horn or other pneumatically actuated alarm device.

FIG. 5 shows a linkage-operated pivotal flag which can be used to indicate visually that arms 21(*a*) are engaged. Flag 144 is connected to a shaft 146, which is in turn connected to a link 148 through a pivot arm 150. When arms 21(*a*) are engaged link 148 is moved upwardly against pivot arm 150 thereby rotating shaft 146 and moving flag 144 counter-clockwise into the up position. Other indicators could be used instead.

Figure 8:
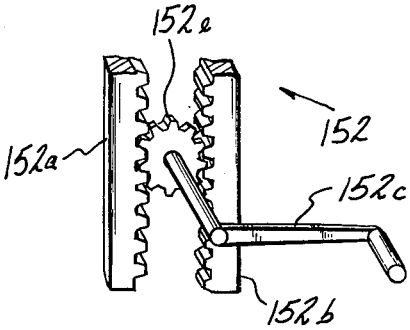
FIG. 8 is a perspective view of a rack and pinion manual crank which can be used to operate the system in case of power failure.

FIG. 8 shows a rack and pinion system 152 which could be incorporated into system 20a) in order to allow manual operation of arms 21(*a*) and plates 21(*d*). For example, a first rack 152(*a*) could be attached to upper arm 21(*a*) and a second rack 152(*b*) could be attached to lower arm 21(*a*). A crank 152(*c*) could then be turned clockwise to rotate a pinion 152(*e*) so as to open or disengage arms 21(*a*). Alternately, crank 152(*c*) could be rotated counter-clockwise so as to engage arms 21(*a*). A similar crank 152(*c*) could be attached to plates 21(*d*) so as to engage and disengage bolts 76.

Figure 9:
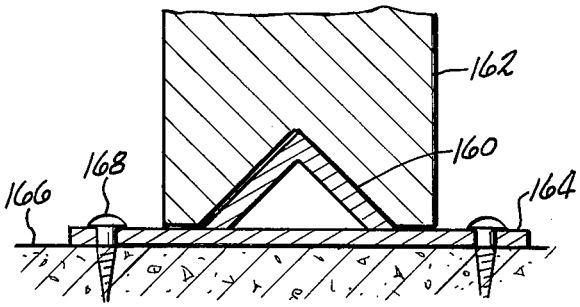
FIG. 9 is a vertical cross-section through a wheel and track device which can be used to help position the jumper systems of FIGS. 1–8.

FIG. 9 shows a positioning rail 160 which could be utilized in conjunction with wheels 162 (see also FIG. 3) to guide jumper system 20(*a*) into position. Rails 160 would be aligned in the aisle adjacent cell series A, B, C, and D at appropriate locations so that conductor 21 and 22 would be properly positioned when inserted between the appropriate cells for disconnecting operation. Rail 160 should be welded to a floor plate 164 which would in turn be attached to the floor 166 of the cell plant by lag bolts 168 or other suitable means so that rail 160 would be firmly positioned with wheels 160 thereon. Rail 160 is shown oriented across the aisle to guide the arms of the conductors into position by moving system 20(*a*) toward cells A, B, C, D. A dolly (not shown) could also be used for moving the system 20(*a*) along the aisle.

Figure 10:
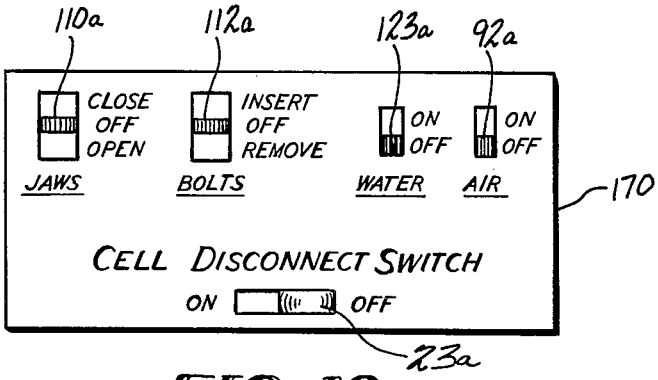
FIG. 10 is a front view of a control panel which can be used in connection with the jumper system of FIGS. 1–8.

FIG. 10 shows a control panel which could be utilized in conjunction with the control section 74 shown in FIGS. 6 and 7. In particular, this control panel 170 includes five switches 110(*a*), 112(*a*), 123(*a*), 23(*a*) and 92(*a*) for controlling operation of arms 21(*a*), plates 21(*b*), valves 123, switch means 23 and valve 92, respectively. Switches 110(*a*), 112(*a*), 123(*a*) and 92(*a*) are moved in order to move valves 110, 112, 123, and 92, respectively. For example, switches 110(*a*) can be moved up to move valves 110 up and in turn close the "jaws" or conductor arms 21(*a*). Alternately, switch 110(*a*) can be pushed down in order to move valve 110 down and thereby open conductor arms 21(*a*). Switches 112(*a*), 123(*a*) and 92(*a*) can be moved in order to move their associated valves in similar fashion. Switch 23(*a*) operates switch means 23.

Figure 11:
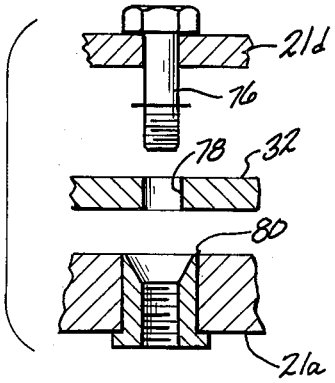
FIG. 11 is an exploded vertical cross-sectional view of a captive bolt and force-fit thread sleeve which can be used with the jumper system of the invention.

FIG. 11 is an exploded view of bolts 76, opening 78, and threaded sleeve 80 which were previously shown in FIG. 6. FIG. 11 is provided so that the relationship between these parts can be better understood. The first step in engaging system 20(*a*) with terminal 32 is to move conductor arm 21(*a*) into contact with terminal 32 as above described. Next, stiffener plates 21(*d*) are moved into contact with the opposite side of terminal 32 thereby shoving bolt 76 through openings 78 in terminal 32 and into threaded sleeve 80 of conductor arms 21(*a*). At this point, although bolts 76 are inserted into threaded sleeve 80, bolts 76 are not threadably engaged or locked into sleeves 80. An additional operation is necessary at this point. Some suitable rotational means is placed on the head of each bolt 76 and bolts 76 are rotated into engagement with the threads of sleeve 80. This rotation continues until a desired contact pressure is reached between conductor arms 21(*a*) and terminal 32. A torque wrench or other torque-limited rotation means is desirable for this purpose so that bolts 76 are not overtightened. Similarly, when it is desired to loosen bolts 76, a suitable rotator is attached again to the head of bolt 76 and bolt 76 is loosened from threads of sleeve 80. After bolts 76 are so loosened, plate 21(*d*) is moved away from terminal 32 and then conductor arm 21(*a*) can be moved away from terminal 32 thereby disengaging jumper system 20(*a*) from terminal 32.

Figure 12:
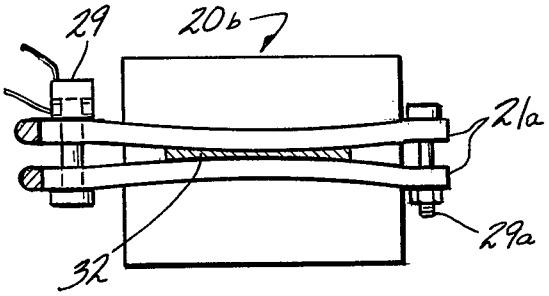
FIG. 12 is a vertical cross section, similar to FIG. 3 except showing a modified clamping system.

FIG. 12 shows an alternate clamping mechanism than that of system 20(*a*) of FIG. 6. Instead of the stiffener plates 21(*d*), the system 20(*b*) of FIG. 12 has a second lower conductor arm 21(*a*) which is held to the upper conductor arm 21(*a*) at its outer end by a hinge bolt 29(*a*) and is moved toward or away from the upper arm 21(*a*) by a hydraulic cylinder 29. Hydraulic cylinder 29 would have sufficient force to generate a 3,000 psi contact pressure between arms 21(*a*) and terminal 32 to flatten surface irregularities and achieve better conductivity therebetween.

From the above description of the structural embodiments and the operation which each part performs, the overall operation of the apparatus is quite clear and self-evident. However, it will be appreciated that minor modifications may be made to the apparatus and method in keeping with the broad scope of the invention below claimed. The following claims are intended to cover all such equivelent modifications. For example, while the invention is disclosed and claimed in terms of chlor alkali diaphragm cells, it is intended to cover all similar electrolytic cells. Similarly, while the invention is described in terms of a horizontal terminal and horizontal jumper system conductor arms, it would be equally applicable to vertical terminals and vertical jumper system conductor arms.

As used herein the "overall" direction of current flow is from right to left in FIGS. 1, 2, and 4 and the "transverse" direction up or down in FIGS. 1, 2, and 4. FIGS. 3 and 6 are taken along a "transverse" plane. "Transverse" can be either prependicular or oblique to the "overall" direction.

What is claimed is:

1. A jumper system for electrically bypassing one cell of a plurality of chloralkali diaphragm cells connected in an electrical series circuit without interrupting the electrical flow through the other cells in said circuit, where each of said cells has vertical anodes and cathodes oriented parallel to the overall direction of current flow in said circuit, cathode and anode terminals lying transversely between said cells and oriented parallel widthwise to said overall direction, and anode current distributor connecting said anodes to said anode terminal and a cathode current collector connecting said cathodes to said cathode terminal, said jumper system comprising:

first transverse conductor means, for assuming a position extending parallel to said cathode terminal and contacting in such position the lengthwise center of the cathode terminal of the cell preceding said one cell in said circuit at a location between said one cell and said preceding cell and for conducting current from said terminal in a direction transverse to said overall direction;

second transverse conductor means for assuming a position extending parallel to said anode terminal and contacting in such a position an anode terminal of the cell following said one cell in said circuit at a location between said one cell and said preceding cell and for conducting current from said terminal in a direction transverse to said overall direction;

controlled means for remotely moving said first and second conductors into pressurized contact in said parallel position with said cathode terminal of said preceding cell and said anode terminal of said following cell respectively; and switch means, adapted to be positioned adjacent said one cell, for selectively allowing and preventing electrical current flow from said first transverse conductor means to said second transverse conductor means whereby current bypasses said one cell.

2. The system of claim 1 wherein at least one of said conductor means is L-shaped and comrises:

a first transfer arm oriented parallel to said overall direction and electrically connected to said switch means, and a first contactor arm oriented transverse to said overall direction and electrically connected to said transfer arm, said first contactor arm being of a length at least equal to one-third of the length of said preceding cell.

3. The system of claim 2 wherein the other of said conductor means is L-shaped and comprises:

a second transfer arm oriented parallel to said overall direction and electrically connected to said switch means, and a second contactor arm oriented transverse to said overall direction and electrically connected to said transfer arm, said second contact arm being of a length at least equal to one-third of the length of said succeeding cell.

4. The system of claim 3 wherein said first and second transfer arms are parallel.

5. The system of claim 4 wherein said first and second contactor arms are parallel to each other and perpendicular to said transfer arms.

6. The jumper system of claim 1 wherein said first and second conductor means lie in the same transverse plane.

7. The jumper system of claim 1, wherein said first conductor means comprises a conductive contact jaw means, having upper and lower contact jaws, for closing about said cathode terminal of said preceding cell and conductively contacting upper and lower surfaces of said cathode terminal.

8. The jumper system of claim 1 wherein said second conductor means comprises a conductive jaw means, having upper and lower contact jaws, for closing about said anode terminal of said following cell and conductively contacting upper and lower surfaces of said anode terminal.

9. The jumper system of claim 8 wherein each of said first second conductor means comprises a conductive jaw means having upper and lower contact jaws for closing about said cathode terminal of said preceding cell and contacting upper and lower surfaces of said cathode terminal.

10. The jumper system of claim 1 wherein:

said preceding cell has at least two vertically spaced, horizontal cathode terminals, said following cell has at least two vertically spaced, horizontal anode terminals said jumper system includes at least one of said first conductor means for each of said horizontal cathode terminals and at least one of said second conductor means for each of said anode terminals.

11. The jumper system of claim 1 wherein said first and second conductor arms and said switch means all are supported by a single housing adapted to be positioned aside and level with said one cell with said first contactor arms projecting from said housing and into the space between said one cell and said preceeding cell and said second contactor arms projecting from said housing and into the space between said one cell and said following cell.

12. The jumper system of claim 1 further comprising fastener means, on at least one of said contactor arms, for passing into an opening on one of said terminals when said one of said terminals is contacted by said one of said contact arms so as to help pressurize the contact between said one contact arm on said one terminal whereby conductance therebetween is increased.

13. The jumper system of claim 12 further comprising tightener means for remotely tightening said fastener means.

14. The jumper system of claim 13 wherein said tightener means is pneumatically powered.

15. The jumper system of claims 7, 8, or 9 further comprising:

jaw closer means for remotely closing and opening said jaw means.

16. The jumper system of claim 1 further comprising at least one first intercell connector means, extending along a line transverse to said overall direction and oriented parallel to said overall direction for conductively connecting at least one anode terminal of said one cell with at least one cathode terminal of said preceding cell along a contact length at least equal to one-quarter the length of said one cell, and at least one second intercell connector means, extending along said line transverse to said overall direction and oriented parallel to said overall direction, for conductively connecting at least one cathode terminal of said one cell with at least one anode terminal of said following cell along a contact length at least equal to one-quarter the length of said one cell.

17. The jumper system of claim 16 wherein each of said intercell connectors overlaps only an outer portion of said cell terminals so as to leave a sufficient inner portion for said contactor arms to contact said terminal said intercell connectors are in place.

18. The jumper system of claim 17, further comprising a remotely operable disconnector means for disconnecting said intercell connector from at least one of the cell terminals which it connects so as to remove said one cell from said electrical circuit.

19. The jumper system of claim 18 wherein said intercell connector includes fastener means for fastening said intercell connector to one of said terminals, and said disconnector means further includes a remotely operable loosener for loosening said fastener means and a remotely operable jack for moving said loosened intercell connector toward one of the cells whose terminals it interconnects so as to allow said one cell to be moved without damage to said intercell connector or said preceding of following cell.

20. The system of claim 1 adapted for use on cells having horizontal cell terminals, wherein said conductors are horizontal.

* * * * *